US006091188A

United States Patent [19]

Tomihari et al.

[11] Patent Number: 6,091,188

[45] Date of Patent: Jul. 18, 2000

[54] FIELD EMISSION COLD CATHODE AND METHOD OF FABRICATING THE SAME

[75] Inventors: Yoshinori Tomihari; Fumihiko Matsuno, both of Tokyo, Japan

[73] Assignee: NEC Corporation, Japan

[21] Appl. No.: 09/050,636

[22] Filed: Mar. 27, 1998

[30] Foreign Application Priority Data

Mar. 31, 1997 [JP] Japan ..... 9-080840

[51] Int. Cl.[7] ..... H01J 1/30

[52] U.S. Cl. ..... 313/336; 313/495; 313/497; 313/309; 313/351

[58] Field of Search ..... 313/495, 496, 313/497, 309, 336, 351

[56] References Cited

U.S. PATENT DOCUMENTS

| | | | |
|---|---|---|---|
| 4,940,916 | 7/1990 | Borel et al. | 313/306 |
| 5,528,103 | 6/1996 | Spindt et al. | 313/351 X |
| 5,550,435 | 8/1996 | Kuriyama et al. | 313/309 X |
| 5,559,389 | 9/1996 | Spindt et al. | 313/336 X |
| 5,789,857 | 8/1998 | Yamaura et al. | 313/495 |

FOREIGN PATENT DOCUMENTS

| | | | |
|---|---|---|---|
| 8133959 | 5/1928 | Japan | H01J 1/00 |

OTHER PUBLICATIONS

"A Thin–Film Field–Emission Cathode" Spindt; J. Applied Physics, vol. 39; No. 7, Jun. 1968; pp. 3504–3505.

*Primary Examiner*—Ashok Patel
*Attorney, Agent, or Firm*—Hayes, Soloway, Hennessey, Grossman and Hage, P.C.

[57] ABSTRACT

There is provided a field emission cold cathode including a semiconductor substrate, an insulating layer formed on the semiconductor substrate, an electrically conductive gate electrode layer formed on the insulating layer, a plurality of cavities being formed throughout both the insulating layer and the gate electrode layer, a conical emitter formed on the semiconductor substrate in each one of the cavities, and an insulating wall formed at least in the semiconductor substrate so that the insulating wall surrounds each one of the cavities. The insulating wall partitions the semiconductor substrate into a first group of blocks located at a marginal end of the semiconductor substrate and a second group of blocks located within the first group of blocks. Each one of the first group of blocks is designed to have a greater area than an area of each one of the second group of blocks. The field emission cold cathode makes it possible to uniformize an emission current in all of the blocks to thereby provide uniform brightness to images in a display area.

23 Claims, 6 Drawing Sheets

FIELD EMISSION COLD CATHODE AND METHOD OF FABRICATING THE SAME

BACKGROUND OF THE INVENTION

1. Field of the Invention

The invention relates to a cold cathode, and more particularly to a field emission cold cathode acting as an electron emitter.

2. Description of the Related Art

A cold cathode array comprising a plurality of fine cold cathodes arranged in an array has already been suggested by C. A. Spindt in "A Thin-Film Field-Emission Cathode", Journal of Applied Physics, Vol. 39, No. 7, pp. 3504–3505, 1968. Each of the fine cold cathodes has a fine conical emitter, and a gate electrode located in the vicinity of an associated cold cathode and having a function of generating a current through an emitter and controlling the thus generated current. This type of cold cathode array is called Spindt type cold cathode, and provides advantages that a higher current density can be obtained than that of a hot cathode, and that a velocity distribution of emitted electrons is relatively small.

In addition, the above-mentioned cold cathode array has smaller current noises than that of a conventional field emission type cold cathode used in an electron microscope, and can operate at a small voltage, for instance, in the range of a couple of volts to 200 volts. Furthermore, whereas a single field emission type cold cathode used in an electron microscope requires a ultra-high vacuum of about $10^{-8}$ Pa for operation thereof, the above-mentioned cold cathode array can operate in a sealed glass tube having a vacuum of about $10^{-}$4 Pa to about $10^{-6}$ Pa by having a gate electrode situated in the close vicinity of an emitter and further by having a plurality of emitters arranged therein.

FIG. 1 is a cross-sectional view illustrating a part of a conventional Spindt type cold cathode array. The illustrated cold cathode array includes a silicon substrate 101, a plurality of fine conical emitters 102 formed on the silicon substrate 101 by vacuum evaporation, and having a height of about 1 $\mu$m, an insulating layer 104 formed on the silicon substrate 101 around each one of the emitters 102, and a gate electrode 103 formed on the insulating layer 104. A plurality of cavities 105 are formed throughout the gate electrode 103 and the insulating layer 104 so that a surface of the silicon substrate 101 is exposed. Each one of the emitters 102 is formed on an exposed area of the silicon substrate 101 in each one of the cavities 105.

The silicon substrate 101 and the emitters 102 are in electrical communication with each other. Specifically, a dc voltage of about 100 V is applied between (a) the silicon substrate 101 and the emitters 102 and (b) the gate electrode 103 in such a manner that the gate electrode 103 is positive. The silicon substrate 101 is spaced away from the gate electrode 103 by a distance of about 1 $\mu$m, and each one of the cavities 105 is designed to have a diameter of about 1 $\mu$m. In addition, each of the emitters 102 is designed to have a quite sharpened apex. Hence, an intensive electric field is applied to the apexes of the emitters 102. When an electric field applied to the apexes of the emitters 102 has an intensity in the range of 2×107 V/cm to 5×107 V/cm, electrons are emitted from the apexes of the emitters 102. As a result, there can be obtained a current in the range of 0.1 $\mu$A to a couple of tens of micro-amperes per an emitter.

By arranging a plurality of fine cold cathodes having the abovementioned structure, on the silicon substrate 101 in an array, there is constituted a planar cathode generating a large amount of current. The Spindt type cold cathode as mentioned above may be applied to an electron tube such as a planar display, a fine vacuum tube, a micro-wave tube and a cathode ray tube, or to an electron source to be used for a variety of sensors.

A field emission type cold cathode is generally designed to have a structure wherein an emitter is spaced away from a gate electrode by a distance of a micrometer order to a sub-micrometer order, and an emitter has a sharpened apex, to thereby cause an intensive electric field to apply to an apex of an emitter. Accordingly, a discharge is difficult to occur between an emitter and a gate electrode in poor vacuum in operation. If a discharge in poor vacuum continued, an emitter and hence a gate electrode and an insulating layer located around the emitter would be molten, resulting in that an emitter and a gate electrode are short-circuited therebetween.

U.S. Pat. No. 4,940,916 to Borel et al. has suggested a solution for preventing a short-circuit between an emitter and a gate electrode, caused by continued discharge. In the suggested solution, a resistive layer is formed on a substrate just below an emitter, and an electrically conductive pattern for providing a current to an emitter is in the form of a mesh.

However, this solution is accompanied with a problem that the conductive pattern mesh makes it impossible to enhance a cold cathode arrangement density. In addition, an emitter arranged in the center of the conductive pattern mesh would have a higher resistance than a resistance of emitters arranged in a marginal area of the conductive pattern mesh, and as a result, would be quite difficult to emit electrons therefrom.

The inventors have suggested a field emission type cold cathode device in Japanese Patent Application No. 8-133959 in order to solve the abovementioned problems. FIG. 2 illustrates the suggested field emission type cold cathode device, which includes a silicon substrate 101, a plurality of fine conical emitters 102 formed on the silicon substrate 101, an insulating layer 104 formed on the silicon substrate 101 around each one of the emitters 102, and a gate electrode 103 formed on the insulating layer 104. A plurality of cavities 105 are formed throughout the gate electrode 103 and the insulating layer 104 so that a surface of the silicon substrate 101 is exposed. Each one of the emitters 102 is formed on an exposed area of the silicon substrate 101 in each one of the cavities 105. The suggested cold cathode device further includes an insulating layer 106 filled in a trench formed in the insulating layer 104 and the silicon substrate 101 so that the trench surrounds each one of the cavities 105.

In the illustrated cold cathode device, since a region immediately below the emitter 102 is surrounded by the insulating layer 106, carriers do not spread towards a surface of the silicon substrate 101, and accordingly, it is possible to avoid a resistivity of the silicon substrate 101 from being decreased. Thus, even if a discharge was made to occur, it would be possible to keep a resistivity of the silicon substrate 101 substantially constant. As a result, a peak current in a discharge can be suppressed.

In addition, since the resistivity of the silicon substrate 101 is divided into pieces by the insulating layer 106 surrounding the cavities 105 therewith, a voltage drop caused by the divided resistivity in normal operation of the cold cathode is smaller than a voltage drop occurring in the above-mentioned resistive layer in U.S. Pat. No. 4,940,916. Specifically, the former is one-Nth of the latter wherein N is the number by which the resistivity is divided. Furthermore, it is not necessary for the cold cathode device illustrated in FIG. 2 to have a horizontal length to form the resistive layer therein, and hence the cold cathode device can enhance a device arrangement density.

In the field emission type cold cathode device illustrated in FIG. 2, since the silicon substrate 101 is divided into blocks each including the emitter 102, it is possible to cause the voltage drop in each of the blocks to be small. However, when electrons are emitted from each of the emitters 102 in normal operation of the cold cathode device, depletion regions 107 are generated on inner surfaces of the insulating layer 106, as illustrated in FIG. 3. As a result, each one of the blocks has a greater resistivity.

The depletion regions 107 are generated because a voltage difference between a first block in which the emitter 102 is formed and a second block which is located adjacent to the first block through the insulating layer 106 and in which no emitters 102 are formed. Specifically, when electrons are emitted from the emitters 102, there occurs a voltage drop due to a resistance in the blocks located outermost. As a result, a voltage just below the emitters 102 emitting electrons therefrom is dropped, which causes a voltage difference between a block in which the emitter 102 is formed and the silicon substrate 101 which is located adjacent to the block through the insulating layer 106, but in which no emitter 102 is formed. The thus generated voltage difference causes the depletion regions 107.

As a larger amount of electrons is emitted from the emitters 102, thicker depletion regions 107 are formed, and finally, an emission current is saturated, as illustrated in FIG. 4. As a result, there is produced uniformity in an emission current between first block located outermost and second blocks located inside the first blocks among the blocks formed by dividing the silicon substrate 101.

If a cold cathode having the above-mentioned uniformity in an emission current between the first and second blocks was applied to a display such as a planar display, there would be caused uniformity in brightness of images in a display area, which would significantly deteriorate image quality.

SUMMARY OF THE INVENTION

In view of the foregoing problems of the conventional cold cathodes, it is an object of the present invention to provide a cold cathode capable of avoiding uniformity in an emission current between substrate blocks in normal operation. It is also an object of the present invention to provide a method of fabricating such a cold cathode.

In one aspect, there is provided a field emission cold cathode including (a) a semiconductor substrate, (b) an insulating layer formed on the semiconductor substrate, (c) an electrically conductive gate electrode layer formed on the insulating layer, a plurality of cavities being formed throughout both the insulating layer and the gate electrode layer, (d) at least one conical emitter formed on the semiconductor substrate in each one of the cavities, and (e) an insulating wall formed at least in the semiconductor substrate so that the insulating wall surrounds each one of the cavities, the insulating wall partitioning the semiconductor substrate into a first group of blocks located at a marginal end of the semiconductor substrate and a second group of blocks located within the first group of blocks, each one of the first group of blocks being designed to have a greater area than an area of each one of the second group of blocks.

For instance, the insulating wall may be composed of either silicon dioxide glass containing boron and phosphorus, or polysilicon.

It is preferable that each one of the second group of blocks is polygonal. For instance, each one of the second group of blocks may be rectangular or square, in which case, it is preferable that each one of the second group of blocks has the same area. It is also preferable that an area of a path formed when a depletion region is generated in each one of the first group of blocks is equal to an area of each of the second group of blocks.

Each one of the first and second group of blocks may include a single emitter, or a plurality of conical emitters therein. If the field emission cold cathode had a circular emission area including the cavities therein, it would be preferable that each one of the second group of blocks is hexagonal.

There is further provided a field emission cold cathode including (a) a semiconductor substrate, (b) an insulating layer formed on the semiconductor substrate, (c) an electrically conductive gate electrode layer formed on the insulating layer, a plurality of cavities being formed throughout both the insulating layer and the gate electrode layer, (d) at least one conical emitter formed on the semiconductor substrate in each one of the cavities, and (e) an insulating wall formed at least in the semiconductor substrate, and having a first portion surrounding all of the cavities and a second portion partitioning the semiconductor substrate into a plurality of blocks in each of which each one of the cavities is located, the first portion having a greater width than a width of the second portion.

There is still further provided a field emission cold cathode including (a) a semiconductor substrate, (b) an insulating layer formed on the semiconductor substrate, (c) an electrically conductive gate electrode layer formed on the insulating layer, a plurality of cavities being formed throughout both the insulating layer and the gate electrode layer, (d) at least one conical emitter formed on the semiconductor substrate in each one of the cavities, (e) an insulating wall formed at least in the semiconductor substrate so that the insulating wall surrounds each one of the cavities, the insulating wall having a first portion surrounding all of the cavities and a second portion partitioning the semiconductor substrate into a plurality of blocks in each of which each one of the cavities is located, and (f) a heavily impurity-doped area formed in the semiconductor substrate on an inner surface and at an upper part of the first portion.

It is preferable that the heavily impurity-doped area is a heavily doped n type area. It is also preferable that the heavily impurity-doped area has a concentration distribution where a concentration of impurities is smaller in a deeper location of the semiconductor substrate.

In another aspect of the invention, there is provided a method of fabricating a field emission cold cathode, including the steps of (a) forming an insulating layer on a semiconductor substrate, (b) forming a photoresist mask over the insulating layer, the photoresist mask having a pattern for forming a trench in the insulating layer and the semiconductor substrate, (c) etching the insulating layer and the semiconductor substrate to thereby form the trench, the trench partitioning the semiconductor substrate into a first group of blocks located at a marginal end of the semiconductor substrate and a second group of blocks located within the first group of blocks, each one of the first group of blocks being designed to have a greater area than an area of each one of the second group of blocks, (d) removing the photoresist mask, (e) filling the trench with an insulating film, (f) forming an electrically conductive gate electrode layer over the structure resulting from the step (e), (g) forming a plurality of cavities throughout the electrically conductive gate electrode layer and the insulating layer, and (h) forming a conical emitter in each one of the cavities.

The above-mentioned method may further include the step of (i) planarizing the insulating film, the step (i) being to be carried out between the steps (e) and (f).

There is further provided a method of fabricating a field emission cold cathode, including the steps of (a) forming an insulating layer on a semiconductor substrate, (b) forming a photoresist mask over the insulating layer, the photoresist mask having a pattern for forming a trench in the insulating layer and the semiconductor substrate, (c) etching the insulating layer and the semiconductor substrate to thereby form the trench, the trench having a first portion surrounding all of the cavities and a second portion partitioning the semiconductor substrate into a plurality of blocks in each of which each one of the cavities is located, the first portion having a greater width than a width of the second portion, (d) removing the photoresist mask, (e) filling the trench with an insulating film, (f) forming an electrically conductive gate electrode layer over the structure resulting from the step (e), (g) forming a plurality of cavities throughout the electrically conductive gate electrode layer and the insulating layer, and (h) forming a conical emitter in each one of the cavities.

There is still further provided a method of fabricating a field emission cold cathode, including the steps of (a) forming an insulating layer on a semiconductor substrate, (b) forming a photoresist mask over the insulating layer, the photoresist mask having a pattern for forming a trench in the insulating layer and the semiconductor substrate, (c) etching the insulating layer and the semiconductor substrate to thereby form the trench, the trench having a first portion surrounding all of the cavities and a second portion partitioning the semiconductor substrate into a plurality of blocks in each of which each one of the cavities is located, (d) removing the photoresist mask, (e) filling the trench with an insulating film, (f) forming a heavily impurity-doped area in the semiconductor substrate on an inner surface and at an upper part of the first portion, (g) forming an electrically conductive gate electrode layer over the structure resulting from the step (f), (h) forming a plurality of cavities throughout the electrically conductive gate electrode layer and the insulating layer, and (i) forming a conical emitter in each one of the cavities.

In accordance with the above-mentioned present invention, it is possible to prevent the first group of blocks from having a high resistivity which would be caused by depletion regions to be formed along the insulating wall. Hence, all of the blocks could have a uniform emission current in normal operation of the field emission cold cathode.

In addition, it is also possible to obtain a trench having good coverage, in which the insulating wall is to be formed. Furthermore, the present invention makes it possible to arrange emitters in a higher density. By applying the field emission cold cathode to a planar display, it is possible to uniformize image brightness in all display area.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

[First Embodiment]

Figure 5A:
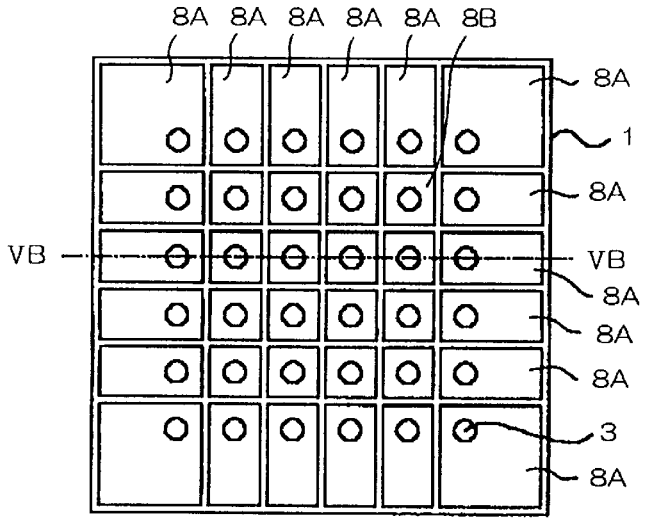
FIG. 5A is a plan view of a field emission type cold cathode in accordance with the first embodiment of the present invention.
Figure 5B:
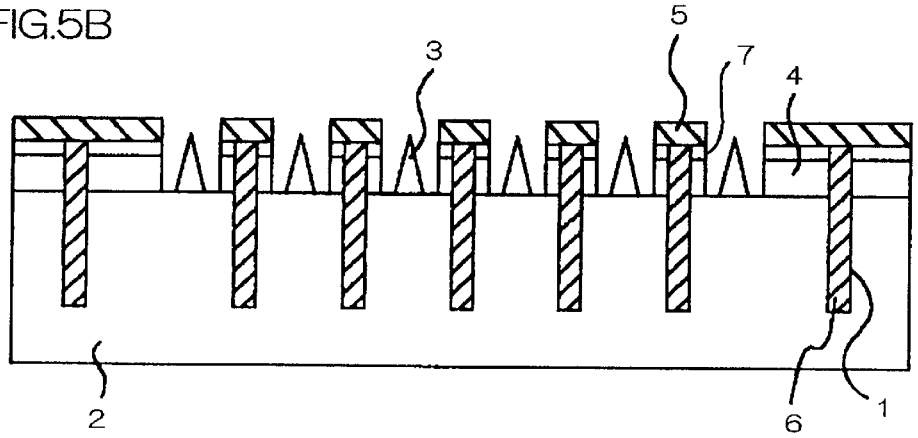
FIG. 5B is a cross-sectional view taken along the line of VB—VB in FIG. 5A.

With reference to FIGS. 5A and 5B, a field emission type cold cathode in accordance with the first embodiment includes a silicon substrate 2, an insulating layer 4 formed on the silicon substrate 2, and an electrically conductive gate electrode layer 5 formed on the insulating layer 4. A plurality of cavities 7 are formed throughout both the gate electrode layer 5 and the insulating layer 4 to thereby expose the silicon substrate 2. The illustrated cold cathode further includes a plurality of conical emitters 3 each of which is formed on the exposed area of the silicon substrate 2 in each of the cavities 7.

The insulating layer 4 and the silicon substrate 2 are formed with a trench 1 in the form of a mesh. The trench 1 is filled with a boronphosphosilicate glass (BPSG) layer 6 as an insulating wall. Herein, boronphosphosilicate glass is silicon dioxide (silica) glass containing boron and phosphorus therein.

The insulating wall or BPSG layer 6 divides the silicon substrate 2 into 36 blocks, and surrounds each one of the cavities 7 in each one of the blocks. The 36 blocks are grouped into a first group of blocks 8A located at a marginal end of the silicon substrate 2 and a second group of blocks 8B located within the first group of blocks 8A. The first group 8A includes 20 blocks, whereas the second group 8B includes 16 blocks. All of the second group of blocks 8B are square, and have the same area. In addition, each one of the second group of blocks 8B is coaxial with an associated cavity 7.

Each one of the first group of blocks 8A is rectangular or square, and is designed to have a greater area than an area of each one of the second group of blocks 8B.

First, an operation of the insulating wall 6 is explained hereinbelow in a cold cathode wherein the first and second groups of blocks 8A and 8B have a common area. The silicon substrate 2 has a resistivity defined by a substrate concentration, an area of a block surrounded by the insulating wall 6, and a depth of the trench 1. Because of the resistivity of the silicon substrate 2, there is generated a voltage drop when electrons are emitted from the emitters 3. That is, the emission of electrons from the emitters 3 causes a voltage just below the emitters 3 to become higher than a voltage of the silicon substrate 2.

Figure 1:
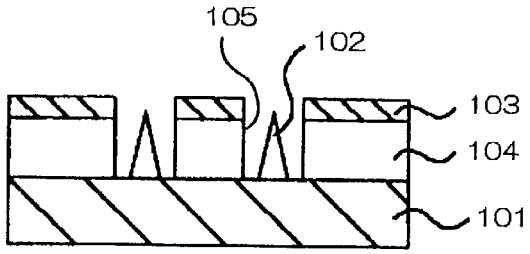
FIG. 1 PRIOR ART
FIG. 1 is a cross-sectional view of a conventional Spindt type cold cathode array.
Figure 2:
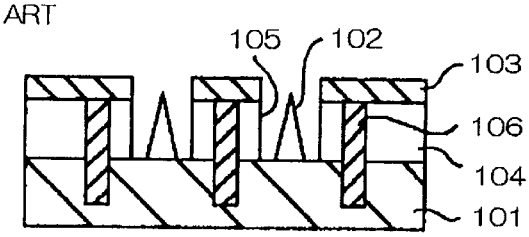
FIG. 2 PRIOR ART
FIG. 2 is a cross-sectional view of a field emission cold cathode disclosed in Japanese Patent Application No. 8-133959.
Figure 3:
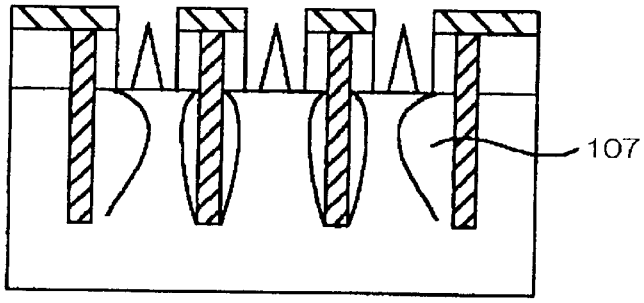
FIG. 3 PRIOR ART
FIG. 3 is a cross-sectional view of the field emission cold cathode illustrated in FIG. 2, in which depletion regions are formed.
Figure 4:
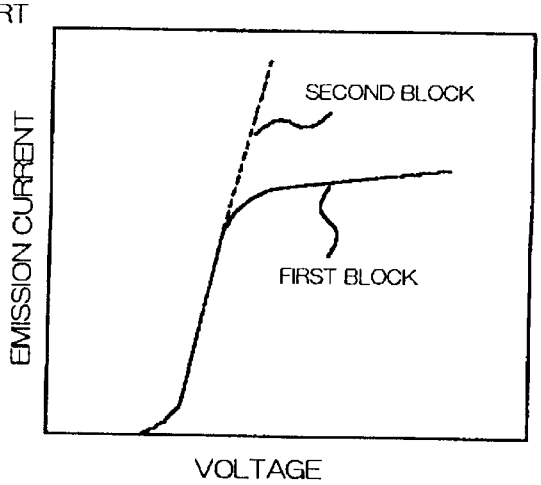
FIG. 4 PRIOR ART
FIG. 4 illustrates a voltage-current characteristic of the field emission cold cathode illustrated in FIG. 2.

Whereas the second group of blocks 8B have the same voltage distribution, a voltage difference occurs among the first group of blocks 8A through the insulating wall 6. Since a voltage just below the emitters 3 becomes higher than a voltage of an area around the emitters 3 when electrons are emitted from the emitters 3, depletion regions (not illustrated in FIG. 5B, see FIG. 3) are formed directing from an inner surface of the insulating wall 6 towards just below the emitters 3. Hence, a substantial area of each one of the blocks becomes smaller, resulting in that a resistance becomes greater. This phenomenon becomes more significant, as an amount of an emission current becomes greater. As a result, an emission current which usually flows in a path in each of the blocks is gradually difficult to flow in the path, and finally, is saturated. Thus, there is generated a remarkable difference between an emission current flowing in a path in the second group of blocks 8B and an emission current flowing in a path in the first group of blocks 8A.

In order to solve this problem, the field emission type cold cathode in accordance with the first embodiment designs the first group of blocks 8A to have a greater area than that of the second group of blocks 8B, as illustrated in FIG. 5A, to thereby prevent the growth of depletion regions which would increase a resistance of an emission current path. The first group of blocks 8A are designed in such a manner that an area of a path formed when a depletion region is generated is equal to an area of each of the second group of blocks 8B. Such an area is determined in dependence on a substrate concentration, a depth of the trench 1, and an amount of a rated current. By designing the first group of blocks 8A in the above-mentioned manner, an emission current is uniformized in all of the first and second groups of blocks 8A and 8B with the result that a highly qualified field emission type cold cathode can be presented.

In the instant embodiment, each one of the first and second groups of blocks 8A and 8B include a single emitter 3. However, it should be noted that each one of the blocks may include two or more emitters 3 therein. Furthermore, the insulating wall 6 may be composed of polysilicon in place of BPSG.

Hereinbelow is explained a method of fabricating the above-mentioned field emission type cold cathode, with reference to FIGS. 6A to 6J.

Figure 6A:
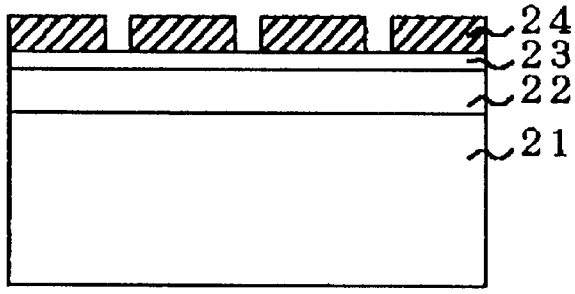
FIGS. 6A to 6J are cross-sectional views of a field emission type cold cathode, illustrating respective steps of a method of fabricating the same.

First, as illustrated in FIG. 6A, a silicon dioxide ($SiO_2$) film 22 having a thickness of about 5000 angstroms, and a silicon nitride ($Si_3N_4$) film 23 having a thickness of about 1500 angstroms are deposited on a silicon substrate 21. Then, a photoresist film 24 is formed over the silicon nitride film 23. The photoresist film 24 is formed with a mesh pattern by photolithography, below which a trench is to be formed in the silicon substrate 21. The mesh pattern is designed in such a manner that a trench partitions the silicon substrate 21 into a first group of blocks 8A (see FIG. 5A) located at a marginal end of the silicon substrate 21 and a second group of blocks located within the first group of blocks 8B (see FIG. 5A), and that each one of the first group of blocks 8A has a greater area than an area of each one of the second group of blocks 8B.

Figure 6B:
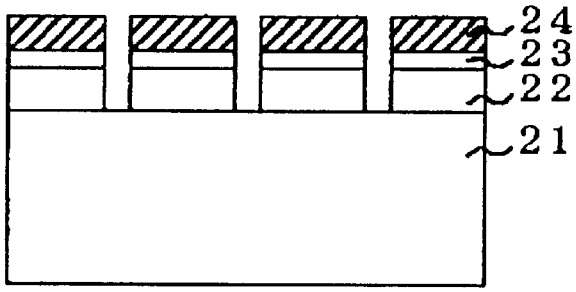

Then, as illustrated in FIG. 6B, the silicon dioxide film 22 and the silicon nitride film 23 are removed by reactive ion etching (RIE).

Figure 6C:
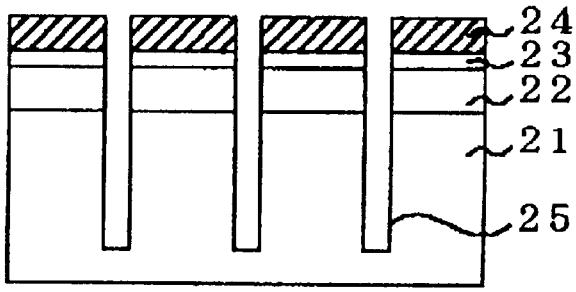

Then, as illustrated in FIG. 6C, the silicon substrate 21 is etched into a predetermined depth by RIE with the photoresist film 24 used as a mask. Thus, a trench 25 having a mesh pattern is formed in the silicon substrate 21. The first group of blocks 8A defined by the thus formed trench 25 have a greater area than an area of each one of the second group of blocks 8B, as mentioned earlier.

Figure 6D:
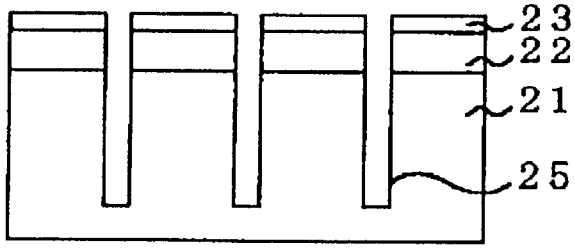

Then, as illustrated in FIG. 6D, after removal of the photoresist film 24, an inner wall of the trench 25 is slightly oxidized.

Figure 6E:
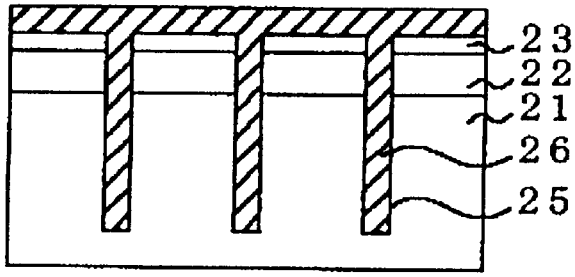

Then, as illustrated in FIG. 6E, a boronphosphosilicate glass (BPSG) film 26 is thick grown by chemical vapor deposition (CVD) over the silicon substrate 21 to thereby fill the trench 25 with the BPSG film 26. The thus formed BPSG film 26 acts as an insulating wall. Then, the BPSG film 26 is heated to thereby be caused to reflow for planarization. The trench 25 may be filled with polysilicon in place of BPSG.

Figure 6F:
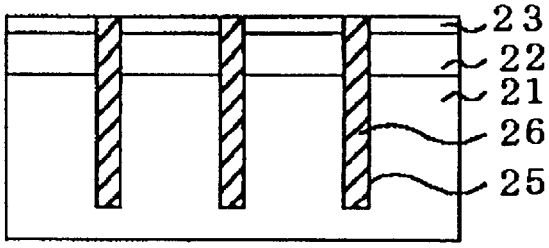

Then, as illustrated in FIG. 6F, the BPSG film 26 is etched back by RIE to thereby expose the silicon nitride film 23. In place of RIE, there may be employed chemical mechanical polishing (CMP) for exposing the silicon nitride film 23. CMP would planarize the silicon nitride film 23 as well as expose the silicon nitride film 23.

Figure 6G:
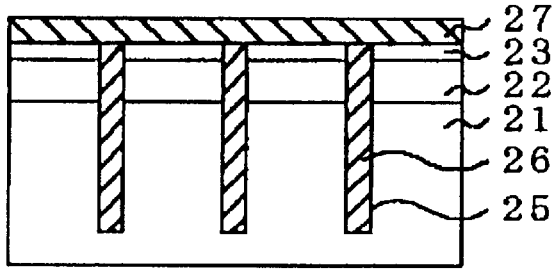

Then, as illustrated in FIG. 6G, gate material such as tungsten (W), molybdenum (Mo) or $WSi_2$ is deposited all over the exposed silicon nitride film 23 by sputtering or evaporation, to thereby form a gate electrode 27 over the silicon nitride film 23.

Figure 6H:
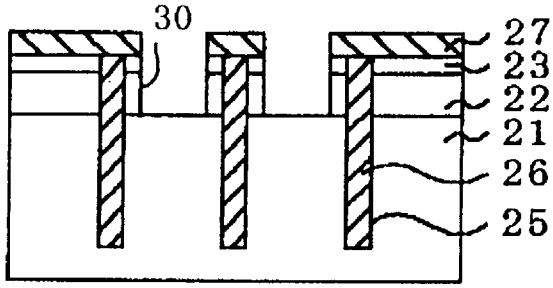
Figure 6I:
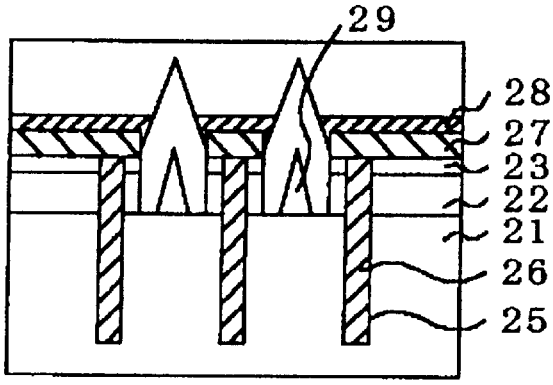

Then, a photoresist film (not illustrated) is deposited all over the gate electrode 27, and patterned by photolithography technique in such a manner that an area where cavities are to be formed is removed. Then, as illustrated in FIG. 6H, the gate electrode 27, the silicon nitride film 23 and the silicon dioxide film 22 are etched by RIE until the silicon substrate 21 is exposed, with the patterned photoresist film used as a mask. Thus, there are formed a plurality of cavities 30. As illustrated in FIG. 6H, each of the thus formed cavities 30 is surrounded by the trench 25 filled with the BPSG film 26. After the formation of the cavities 30, the photoresist film is removed.

Then, as illustrated in FIG. 61, a sacrifice layer 28 composed of MgO or Al is formed by oblique rotation evaporation. Thereafter, refractive material as emitter material such as W and Mo is evaporated vertically into each one of the cavities 30 to thereby form a conical emitter 29 in each one of the cavities 30. Then, the sacrifice layer 28 is removed by etching with the result of surplus emitter material deposited over the sacrifice layer 28 is lifted off.

Figure 6J:
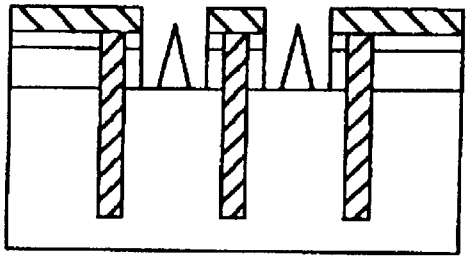

Thus, there is completed a field emission type cold cathode illustrated in FIG. 6J.

[Second Embodiment]

Figure 7A:
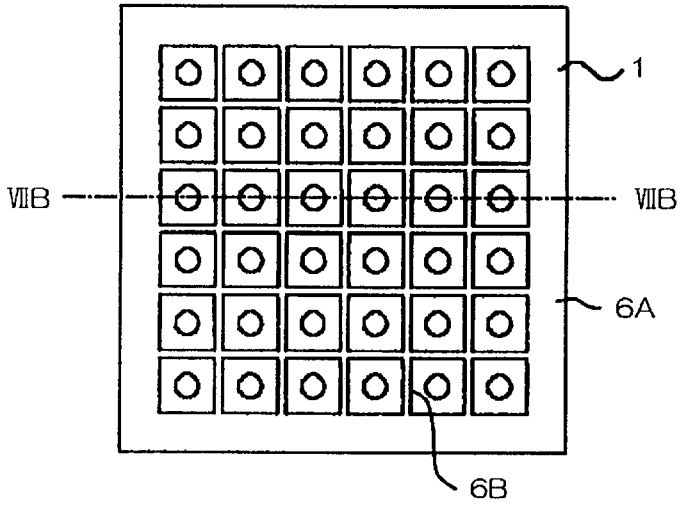
FIG. 7A is a plan view of a field emission type cold cathode in accordance with the second embodiment of the present invention.
Figure 7B:
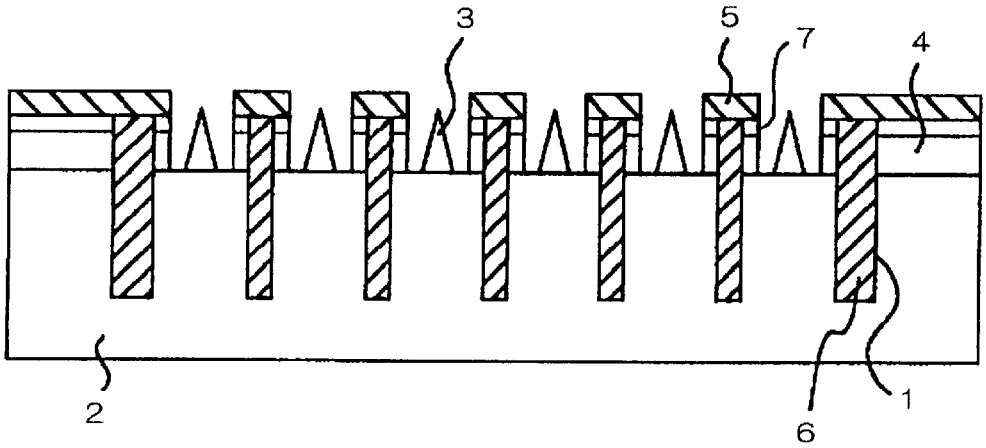
FIG. 7B is a cross-sectional view taken along the line of VIIB—VIIB in FIG. 7A.

With reference to FIGS. 7A and 7B, a field emission type cold cathode in accordance with the second embodiment includes a silicon substrate 2, an insulating layer 4 formed on the silicon substrate 2, and an electrically conductive gate electrode layer 5 formed on the insulating layer 4. A plurality of cavities 7 are formed throughout both the gate electrode layer 5 and the insulating layer 4 to thereby expose the silicon substrate 2. The cold cathode further includes a plurality of conical emitters 3 each of which is formed on the exposed area of the silicon substrate 2 in each of the cavities 7.

The insulating layer 4 and the silicon substrate 2 are formed with a trench 1 in the form of a mesh. The trench 1 is filled with BPSG layer 6 as an insulating wall.

The insulating wall or BPSG layer 6 is designed to have a first portion 6A surrounding all of the cavities 7 therewith, and a second portion 6B partitioning the silicon substrate 2 into 36 blocks in each of which each one of the cavities 7 is located. All of the blocks are square, and have the same area. Each one of the blocks is coaxial with an associated cavity 7.

Unlike the first embodiment illustrated in FIGS. 5A and 5B, the trench 1 in the second embodiment does not the silicon substrate 2 into the first and second groups of blocks 8A and 8B. Instead, the second embodiment is characterized by that the first portion 6A of the BPSG film or insulating wall 6 is designed to have a greater width than a width of the second portion 6B.

The first portion 6A of the insulating wall 26 having a greater width than that of the second portion 6B weakens an electric field in the 36 blocks of the silicon substrate 2 partitioned by the second portion 6B of the BPSG film 6. As a result, depletion regions are difficult to extend in each one of the blocks in normal operation of the field emission type cold cathode.

Similarly to the first embodiment, the second embodiment provides an advantage that an emission current is uniformized in all of the blocks with the result that a highly qualified field emission type cold cathode can be presented.

[Third Embodiment]

Figure 8A:
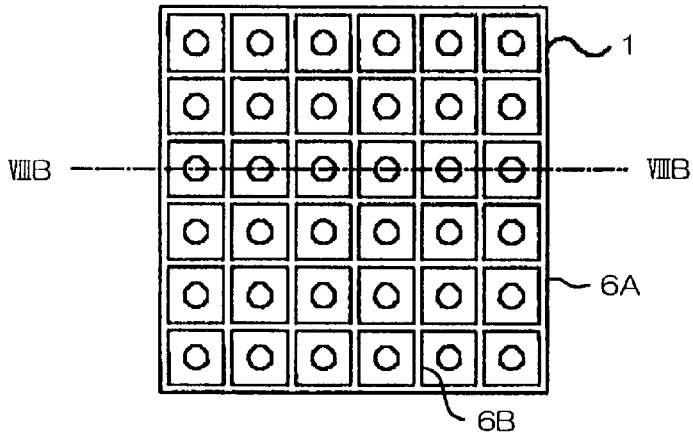
FIG. 8A is a plan view of a field emission type cold cathode in accordance with the third embodiment of the present invention.
Figure 8B:
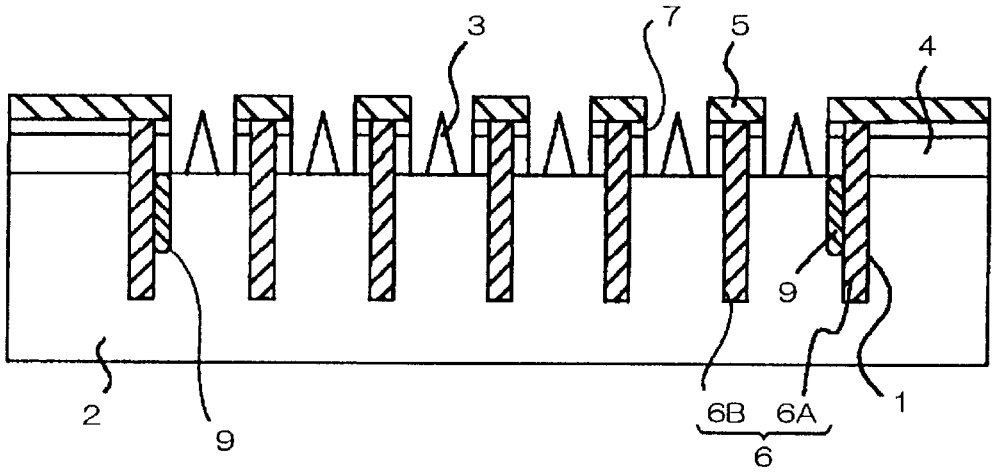
FIG. 8B is a cross-sectional view taken along the line of VIIIB—VIIIB in FIG. 8A.

With reference to FIGS. 8A and 8B, a field emission type cold cathode in accordance with the third embodiment includes a silicon substrate 2, an insulating layer 4 formed on the silicon substrate 2, and an electrically conductive gate electrode layer 5 formed on the insulating layer 4. A plurality of cavities 7 are formed throughout both the gate electrode layer 5 and the insulating layer 4 to thereby expose the silicon substrate 2. The cold cathode further includes a plurality of conical emitters 3 each one of which is formed on the exposed area of the silicon substrate 2 in each one of the cavities 7.

The insulating layer 4 and the silicon substrate 2 are formed with a trench 1 in the form of a mesh. The trench 1 is filled with BPSG layer 6 as an insulating wall.

The insulating wall or BPSG layer 6 is designed to have a first portion 6A surrounding all of the cavities 7 therewith, and a second portion 6B partitioning the silicon substrate 2 into 36 blocks in each of which each one of the cavities 7 is located. All of the blocks are square, and have the same area unlike the first embodiment. Each one of the blocks is coaxial with an associated cavity 7. Unlike the second embodiment, the BPSG film 6 is designed to have a uniform width.

The field emission type cold cathode in accordance with the instant embodiment further includes and is characterized by a heavily impurity-doped area 9 formed in the silicon substrate 2 on an inner surface and at an upper part of the first portion 6A of BPSG film 6. The heavily impurity-doped area 9 is constituted of a $n^+$ region formed by ion-implanting n-type impurities into the silicon substrate 2. Impurities are ion-implanted in heavy dope selectively onto an upper part of an inner surface of the first portion 6A of the insulating wall 6, because a depletion region readily extends in the vicinity of the upper part of the first portion 6A. As an alternative, impurities are ion-implanted in a profile where a concentration of impurities is lower at a lower position of the area 9. It should be noted that the heavily impurity-doped area 9 must not extend all over an inner surface of the first portion 6A of the insulating wall 6.

The cold cathode in accordance with the instant embodiment operates as follows. A voltage difference is at the maximum thereof just below the emitter 3 in normal operation of a cold cathode, and hence, a depletion region extends more readily at an upper part than at a lower part of the insulating wall 6. Accordingly, by ion-implanting impurities in heavy dope selectively into a region of the silicon substrate 2 where a depletion region could readily extend, to thereby form the heavily impurity-doped area 9 on an inner surface and at an upper part of the first portion 6A of BPSG film 6, it would be possible to prevent a depletion region from extending in the region. However, if the heavily impurity-doped area 9 was formed all over an inner surface of the first portion 6A of the insulating wall 6, a discharge current would flow through the heavily impurity-doped area 9, resulting in that a requisite breakdown voltage cannot be obtained. Hence, as mentioned earlier, the heavily impurity-doped area 9 has to be formed so that the area 9 does not entirely cover an inner surface of the first portion 6A of the insulating wall 6 therewith.

Similarly to the first and second embodiments, the second embodiment provides an advantage that an emission current is uniformized in all of the blocks with the result that a highly qualified field emission type cold cathode can be presented.

[Fourth Embodiment]

Figure 9:
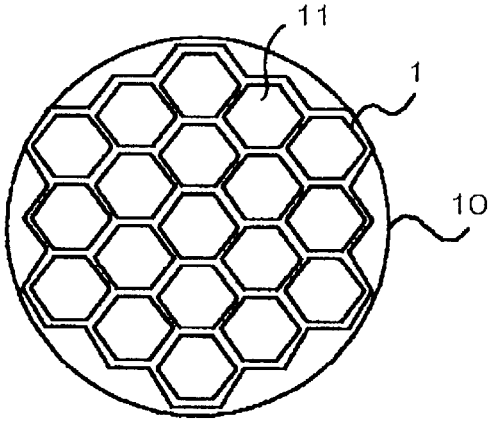
FIG. 9 is a plan view of a field emission type cold cathode in accordance with the fourth embodiment of the present invention.

FIG. 9 illustrates a field emission type cold cathode in accordance with the fourth embodiment. The illustrated cold cathode has a circular emission region 10 having a fixed area. Such a circular emission region 10 is widely used in a cold cathode to be used for an electron tube such as a microwave tube and a cathode ray tube. In the instant embodiment, the trench 1 partitions the silicon substrate 2 into 19 hexagonal blocks 11.

It is effectual to divide a rectangular emission region into a plurality of square blocks with the trench 1, as illustrated in FIG. 5A, in a device comprised of rectangular cells. However, if a circular emission region was divided into square blocks similarly to FIG. 5A, a density with which the emitters 3 are arranged would be decreased. In addition, if a circular emission region was divided into square blocks, an area of intersections at which the trench 1 intersects with each other would become large, resulting in that the intersections would not be sufficiently filled with the BPSG film 6 in the next step, which might cause cavities in the BPSG film or insulating wall 6.

To the contrary, since the blocks are formed in hexagon in the field emission type cold cathode illustrated in FIG. 9, the blocks can be arranged at a higher density than a cold cathode having the square blocks. Furthermore, an area of intersections at which the trench 1 intersects with each other in the cold cathode having hexagonal blocks would be smaller than that of a cold cathode having square blocks, resulting in better coverage with the BPSG film 6, which presents a highly qualified cold cathode.

In the cold cathode in accordance with the fourth embodiment, any one of the first to third embodiments may be employed in order to suppress the saturation of an emission current.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 9-80840 filed on Mar. 31, 1997 including specification, claims, drawings and summary is incorporated herein by reference in its entirety.

What is claimed is:

1. A field emission cold cathode comprising:

(a) a semiconductor substrate;

(b) an insulating layer formed on said semiconductor substrate;

(c) an electrically conductive gate electrode layer formed on said insulating layer, a plurality of cavities being formed throughout both said insulating layer and said gate electrode layer;

(d) at least one conical emitter formed on said semiconductor substrate in each one of said cavities; and (e) an insulating wall formed at least in said semiconductor substrate so that said insulating wall surrounds each one of said cavities, said insulating wall partitioning said semiconductor substrate into a first group of blocks located at a marginal end of said semiconductor substrate and a second group of blocks located within said first group of blocks, each one of said first group of blocks being designed to have a greater area than an area of each one of said second group of blocks.

2. The field emission cold cathode as set forth in claim 1, wherein said insulating wall is composed of silicon dioxide glass containing boron and phosphorus.

3. The field emission cold cathode as set forth in claim 1, wherein said insulating wall is composed of polysilicon.

4. The field emission cold cathode as set forth in claim 1, wherein each one of said second group of blocks has the same area.

5. The field emission cold cathode as set forth in claim 1, wherein each one of said second group of blocks is polygonal.

6. The field emission cold cathode as set forth in claim 1, wherein an area of a path formed when a depletion region is generated in each one of said first group of blocks is equal to an area of each of said second group of blocks.

7. The field emission cold cathode as set forth in claim 1, wherein each one of said first and second group of blocks includes a plurality of conical emitters therein.

8. The field emission cold cathode as set forth in claim 1, wherein said field emission cold cathode has a circular emission area including said cavities therein, and wherein each one of said second group of blocks is hexagonal.

9. A field emission cold cathode comprising:

(a) a semiconductor substrate;

(b) an insulating layer formed on said semiconductor substrate;

(c) an electrically conductive gate electrode layer formed on said insulating layer, a plurality of cavities being formed throughout both said insulating layer and said gate electrode layer;

(d) at least one conical emitter formed on said semiconductor substrate in each one of said cavities; and (e) an insulating wall formed at least in said semiconductor substrate, and having a first portion surrounding all of said cavities and a second portion partitioning said semiconductor substrate into a plurality of blocks in each of which each one of said cavities is located, said first portion having a greater width than a width of said second portion.

10. The field emission cold cathode as set forth in claim 9, wherein said insulating wall is composed of silicon dioxide glass containing boron and phosphorus.

11. The field emission cold cathode as set forth in claim 9, wherein said insulating wall is composed of polysilicon.

12. The field emission cold cathode as set forth in claim 9, wherein each one of said blocks has the same area.

13. The field emission cold cathode as set forth in claim 9, wherein each one of said blocks is polygonal.

14. The field emission cold cathode as set forth in claim 9, wherein each one of said blocks includes a plurality of conical emitters therein.

15. The field emission cold cathode as set forth in claim 9, wherein said field emission cold cathode has a circular emission area including said cavities therein, and wherein each one of said blocks is hexagonal.

16. A field emission cold cathode comprising:

(a) a semiconductor substrate;

(b) an insulating layer formed on said semiconductor substrate;

(c) an electrically conductive gate electrode layer formed on said insulating layer, a plurality of cavities being formed throughout both said insulating layer and said gate electrode layer;

(d) at least one conical emitter formed on said semiconductor substrate in each one of said cavities;

(e) an insulating wall formed at least in said semiconductor substrate so that said insulating wall surrounds each one of said cavities, said insulating wall having a first portion surrounding all of said cavities and a second portion partitioning said semiconductor substrate into a plurality of blocks in each of which each one of said cavities is located; and (f) a heavily impurity-doped area formed in said semiconductor substrate on an inner surface and at an upper part of said first portion.

17. The field emission cold cathode as set forth in claim 16, wherein said heavily impurity-doped area is a heavily doped n-type area.

18. The field emission cold cathode as set forth in claim 16, wherein said heavily impurity-doped area has a concentration distribution where a concentration of impurities is smaller in a deeper location of said semiconductor substrate.

19. The field emission cold cathode as set forth in claim 16, wherein said insulating wall is composed of silicon dioxide glass containing boron and phosphorus.

20. The field emission cold cathode as set forth in claim 16, wherein said insulating wall is composed of polysilicon.

21. The field emission cold cathode as set forth in claim 16, wherein each one of said blocks has the same area.

22. The field emission cold cathode as set forth in claim 16, wherein each one of said blocks includes a plurality of conical emitters therein.

23. The field emission cold cathode as set forth in claim 16, wherein said field emission cold cathode has a circular emission area including said cavities therein, and wherein each one of said blocks is hexagonal.

* * * * *